US005383724A

United States Patent [19]

Wrangberth et al.

[11] Patent Number: 5,383,724

[45] Date of Patent: Jan. 24, 1995

[54] DEVICE FOR A DISHWASHER DOOR

[75] Inventors: Jan S. Wrangberth, Huskvarna; Nils S. Nilsson, Ödeshög, both of Sweden

[73] Assignee: Aktiebolaget Electrolux, Sweden

[21] Appl. No.: 72,039

[22] Filed: Jun. 4, 1993

[30] Foreign Application Priority Data

Jun. 17, 1992 [SE] Sweden ..... 9201868

[51] Int. Cl.[6] ..... A47L 15/42

[52] U.S. Cl. ..... 312/325

[58] Field of Search ..... 312/228, 325

[56] References Cited

U.S. PATENT DOCUMENTS

| | | | |
|---|---|---|---|
| 2,420,015 | 5/1947 | Salsman et al. | 312/325 X |
| 4,756,054 | 7/1988 | Mitts et al. | 312/325 X |
| 4,900,109 | 2/1990 | Boston, Jr. et al. . | |
| 5,226,706 | 7/1993 | Tuller | 312/228 |

FOREIGN PATENT DOCUMENTS

| | | | |
|---|---|---|---|
| 158826 | 7/1990 | Denmark . | |
| 1238155 | 6/1960 | France . | |
| 2037243 | 3/1971 | Germany . | |
| 2937369 | 4/1981 | Germany . | |
| 3003951 | 8/1981 | Germany | 312/325 |
| 3140039 | 6/1992 | Germany . | |
| 2130478 | 6/1984 | United Kingdom . | |

*Primary Examiner*—Richard E. Gluck

*Attorney, Agent, or Firm*—Pearne, Gordon, McCoy & Granger

[57] ABSTRACT

The present invention relates to an assembly for mounting an outer or external panel to a door for a mid-sized built in dishwasher. A treatment chamber access opening is normally covered by a dishwasher door (17) which is pivotally supported at its lower horizontal edge for movement from a vertical, closed position to a horizontal, open position. The dishwasher door (17) includes an outer door (18) with a panel whose peripheral parts (19) facing the treatment chamber are placed adjacent a front edge (20) of a cabinet shell surrounding the chassis (21) when the dishwasher door is in its closed position. During movement of the dishwasher door from the closed to the open positions, a lower edge of the outer door (18) is always positioned in front of a vertical plane defined by the front edges (20) of the cabinet shell, allowing the outer door to move without interference from the surrounding cabinetry.

4 Claims, 3 Drawing Sheets

DEVICE FOR A DISHWASHER DOOR

BACKGROUND OF THE INVENTION

The present invention generally relates to dishwashers and, more particularly, to dishwasher doors which are pivoted about a lower horizontal edge to move from a normally closed, vertical position to an open, horizontal position.

Such door arrangements are used in almost all types of dishwashers, whether they are floor supported dishwashers, or counter-top dishwashers. In floor supported dishwashers, i.e., machines placed on the floor and extending up to the underside of a counter-top or a kitchen sink, it is often desirable to conform the appearance of the dishwasher door to the surrounding cabinetry by attaching a decorative or ornamental panel to the outside of the door.

Different types of support arrangements have been suggested to coordinate the pattern of movement of the panel to the movement of the dishwasher door whereby a lower portion of the panel will enter a bottom or base area of the dishwasher situated immediately above the floor. In this regard see, for instance, DE 2937369. Movement of the decorative panel into the base of the dishwasher is usually not a disadvantage since the base area does not have any function when the door is in its horizontal or open position.

In counter-top dishwashers, i.e., small machines which are placed in a kitchen sink or on a counter-top, there usually is not the same need to coordinate the appearance of the dishwashing machine with the surrounding cabinetry since the machine usually is regarded as a free standing or separate object which is not linked to the surrounding cabinets.

SUMMARY OF THE INVENTION

One of the purposes of the present invention is to provide a new type of dishwasher which, with regard to its size, is between or intermediate a floor supported dishwasher and a counter-top dishwasher. It is a further purpose of the present invention to provide a dishwashing machine which is built-in at a suitable height in a cabinet shell and which is equipped or provided with an outside panel which is coordinated with the surrounding cabinetry.

In this type of built-in arrangement it is not possible to use a conventional dishwasher door with exterior panels. The lower part of the dishwasher door, during movement from a generally vertical, closed position to a generally horizontal, open position, would abut the front edges of the adjacent or surrounding cabinet shell and thus be hindered or prevented from moving.

One of the purposes of the present invention is to achieve a built-in dishwasher wherein the opening movement of the door from a generally vertical, closed position to a generally horizontal, open position is not hindered by the surrounding cabinet shell. Preferably, the built-in dishwasher is of a medium size, intermediate conventional built-ins and counter- top dishwashers.

BRIEF DESCRIPTION OF THE DRAWINGS

Two embodiments of the invention will now be described with reference to the accompanying drawings wherein.

DETAILED DESCRIPTION OF THE PREFERRED EMBODIMENTS

Figure 1:
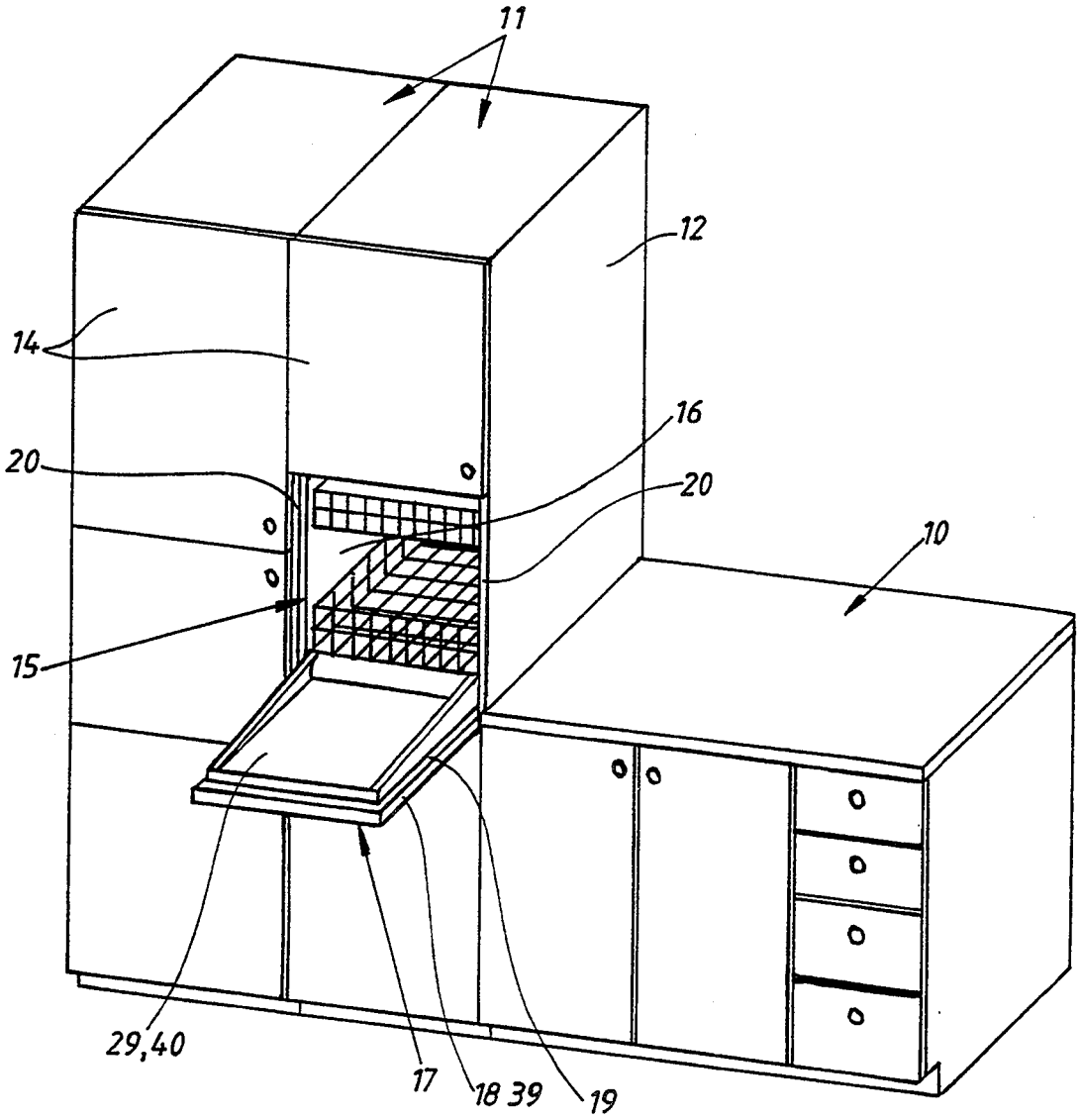
FIG. 1 is a perspective view of a cabinet with a built-in dishwasher according to the present invention.

FIG. 1 shows a kitchen sink 10 with associated cabinets 11. The cabinets 11 are shaped as a shell with sidewalls 12 and horizontal plates 13 (FIGS. 2 and 3) forming compartments therein. The compartment openings are covered by lids or doors 14. In one of these compartments, a built-in type dishwashing machine 15 is installed. The machine 15 is medium-sized, i.e., having a size which is between that of a conventional floor supported built-in dishwasher and a conventional counter-top dishwasher.

A front part of the dishwashing machine defines an opening through which the machine's treatment chamber 16 is accessible to allow the insertion of dishes therein and the removal of dishes therefrom. The opening is normally covered by a door 17.

The dishwasher door 17 is pivotally supported and movable between a vertical, closed position and a horizontal, open position, and has an outer door or panel 18 corresponding in appearance to the surrounding cabinetry. In the vertical, closed position a peripheral inner edge part 19 of the outer panel 18 is adjacent to or abuts a front edge 20 of the cabinet shell. The cabinet shell surrounds the chassis 21 on which the dishwasher is built, as illustrated.

Figure 2:
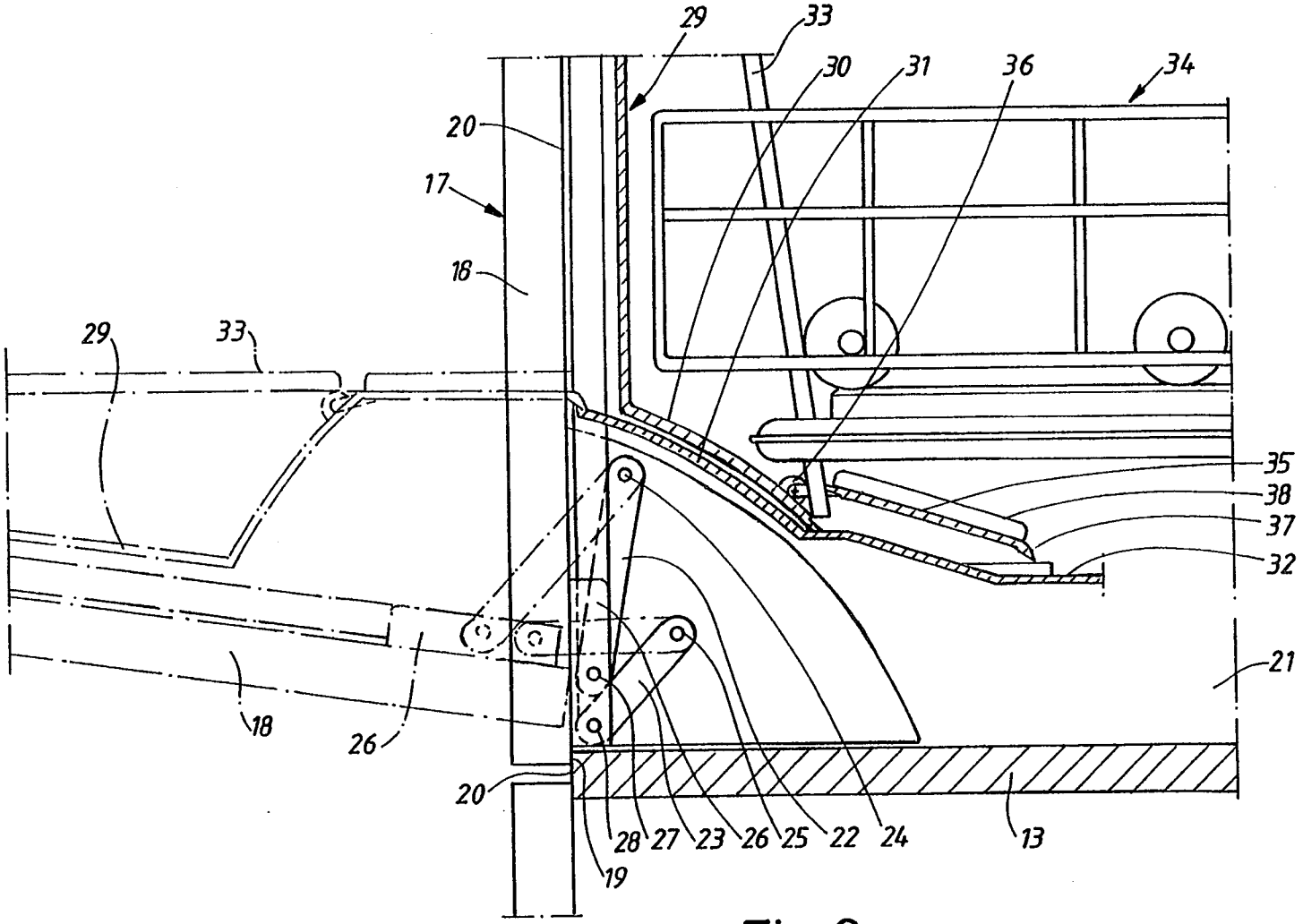
FIG. 2 is a vertical section of the lower front part of a first embodiment of the present invention wherein full lines illustrate the dishwasher door in a vertical, closed position and dash-dotted lines illustrate the dishwasher door in a horizontal, open position; and, FIG. 3 is a vertical section of a lower front part of a second embodiment of the present invention wherein full lines illustrate the dishwasher door in a vertical, closed position and dash-dotted lines illustrate the dishwasher door in a horizontal, open position.

The embodiment of FIG. 2 provides an arrangement in which the panel 18 is connected to the chassis 21 via two link arm mechanisms. Each link arm mechanism is attached to a side of the panel 18 and includes first and second arms 22 and 23. The first and second arms 22, 23 each have a first end pivotally secured to the chassis 21 at 24 and 25, respectively. A second or opposite end of each arm 22, 23 is pivotally fastened to an angle iron 26 at 27 and 28, respectively. The angle iron 26 is preferably located at a lower corner or edge of the outer door or panel 18, as illustrated.

An inner door 29 is attached to the outer door 18. The inner door 29 seals against the chassis 21 of the dishwasher and serves as a front wall of the treatment chamber 16. The inner door 29 has a curved part 30 which, when the door 29 is in the vertical, closed position, covers an upwardly extending front part 31 of the bottom of the treatment chamber 16.

The inner door 29 includes support means 33 for supporting a wheeled basket or rack 34. Dishes are stored or placed in the basket or rack 34 which, when in its drawn-out position, rests on the door. At a lower area of the curved part 30 (when the door is in its vertical, closed position) there is a flap 35 extending over the complete width of the dishwasher. The flap 35 is movably or pivotally secured by means of lugs 36 which are provided on the inner door 29. One end of the flap 35 is shaped as a scraping edge 37 to slide on the upwardly extending front part 31 of the bottom of the treatment chamber 16 during the closing motion of the door. At the end of the closing motion the scraping edge 37 also slides on the bottom of the treatment chamber 16 and on beads or the like which are provided on the bottom of the treatment chamber.

Thus, an opening is created for the water which, during the wash cycle, flows downwardly from the inner door 29, over the curved part 30, and under the flap 35, cleaning the area under the flap 35. The flap 35 also has a support part 38 which, when the door 17 is in the horizontal, open position, is a continuation of the support means 33 for the basket 34. When the door is open the flap 35 prevents food scraps and cutlery items from falling down into the area between the inner door 29 and the upwardly extending front part 31 of the bottom of the treatment chamber 16. The scraping edge 37 cleans the upwardly extending front part 31 when the door is moved from the horizontal, open position to the vertical, closed position.

By means of the above-described arrangement, a pattern of movement of the door 17 is achieved that allows the outer panel 18 to move freely outside the vertical plane defined by the front edge 20 of the surrounding cabinet shell. The inner door 29 follows the movement of the outer door 18 and, thus, does not turn or pivot about a fixed axis.

Figure 3:
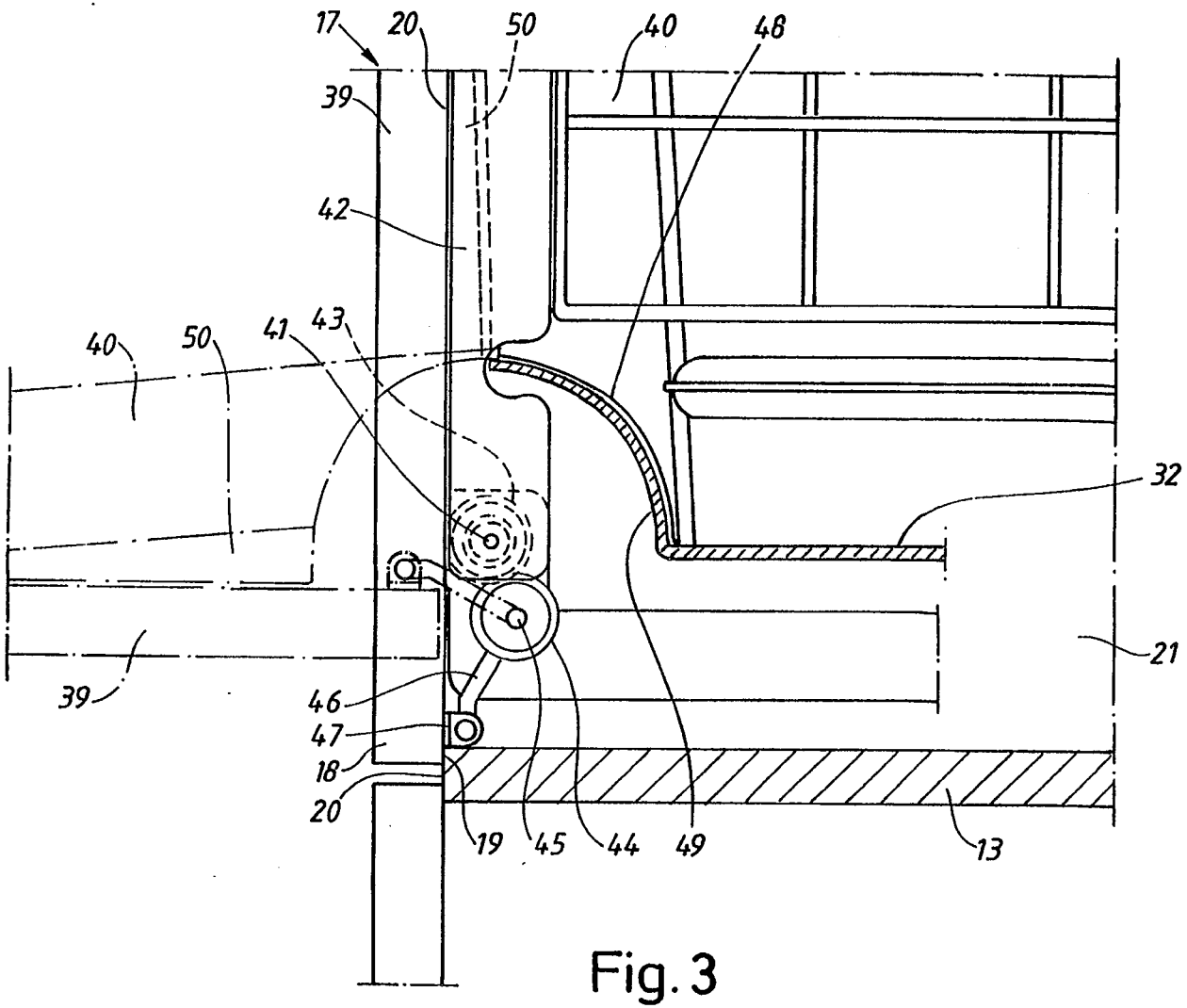

According to the second preferred embodiment described in FIG. 3, the door 17 comprises an outer or exterior panel 39 and an inner door 40. The outer panel 39 and inner door 40 are connected so that they can be displaced with respect to each other.

In this embodiment, the inner door 40 is pivotally secured to the chassis 21 about a horizontal axis at the lower edge of the dishwasher door 17 by means of two dowels 41, each dowel 41 being fixed to a bracket 42 which is provided by the inner door 40. A toothed wheel 43 is secured to each dowel 41. Each of the wheels 43 are turned during the turning or pivoting motion of the door 17 and engage another toothed wheel 44 which is rotatably supported by the chassis 21 at 45. The last-mentioned toothed wheel 44 supports an arm 46 which follows the toothed wheel 44 during its turning motion. An outer or remote end of the arm 46 is secured to a lug 47 arranged on the outer panel 39.

The lower part 48 of the inner door 40, which, as illustrated, is curved in this embodiment, overlaps a curved front part 49 of the bottom 32 of the treatment chamber when the dishwasher door 17 is in the vertical, closed position. The two curved parts 48, 49 are arranged and placed so that the movable curved part 48 of the inner door 40 serves as a scraping means for the rigid curved part 49 of the treatment chamber bottom 32. When the door 17 is opened, the part 48 will prevent the creation or formation of a space or gap between the inner door 40 and the curved front part 49 into which food scraps and cutlery items can fall.

During the opening movement of the door 17, the toothed wheels 43 and 44 and, hence, the arm 46 are turned. The outer panel 39 is displaced mainly parallel to the inner door 40 and also achieves a turning or pivoting motion with respect to the inner door 40. In order to allow this movement, the outer panel 39 and the inner door 40 are connected to each other via a dowel-slot arrangement (not shown) positioned in the upper part of the door 17 when the door is closed. Therefore, as the inner door 40 pivots about the axis defined by dowels 41, the outer panel simultaneously pivots about the axis defined by the dowels 41 and vertically slides under the influence of the arm 46 and toothed wheels 43, 44.

However, during the turning motion, the lower edge of the outer panel 39 will, at all times, be situated in front of a vertical plane which is defined by a front edge 20 of the surrounding cabinet shell. In order to prevent the creation of a gap or space of various sizes between the outer panel 39 and the inner door 40 during the turning motion, side walls 50 are arranged on the outer panel 39. The sidewalls 50 are parallel to the side edges of the inner door 40.

It should be observed that at the last mentioned arrangement of course is possible with the same function to replace the toothed wheels by toothed segments or the like.

While the preferred embodiments of the present invention are shown and described herein, it is to be understood that the same is not so limited but shall cover and include any and all modifications thereof which fall within the purview of the invention.

What is claimed is:

1. A device for a dishwasher, said dishwasher comprising a chassis (21) with a treatment chamber (16) for dishes, one side wall of the treatment chamber being provided with an access opening through which an interior of the treatment chamber is accessible to insert dishes therein and remove dishes therefrom, said opening normally being covered by a dishwasher door (17), said door being pivotally supported adjacent a lower horizontal edge such that the door can be moved between a normally closed, generally vertical position and an open, mainly horizontal position, wherein the dishwasher is a built-in machine in which the dishwasher door (17) comprises an inner door (29) and an outer door (18, 39), said inner door having means (35) for covering a space between the inner door and a front part (31) of a bottom (32) of the treatment chamber when the dishwasher door is in the open position, said outer door having peripheral parts (19) which face the treatment chamber, said peripheral parts being adjacent a front edge (20) of a cabinet shell surrounding the chassis (21) when the dishwasher door is in the closed position, the lower edge of the outer door (18, 39) being pivotally supported at first pivot points (28, 47) whereby, when the dishwasher door is in the closed position, the first pivot points are inside the front edge (20) of the cabinet shell and, when the dishwasher door is in the open position, the first pivot points are displaced outwardly and upwardly relative to the front edge of the cabinet shell, said outer door also being supported by second pivot points (24, 41) which are spaced a distance from the first pivot points (28).

2. A device according to claim 1, wherein the outer door (18) is firmly secured to the inner door (29), said inner door facing the treatment chamber when the dishwasher door (17) is in the closed position, each side of the outer door being supported in the chassis (21) by means of a link arm mechanism.

3. A device according to claim 2, wherein each link arm mechanism comprises two arms (22, 23), a first end of each arm being fastened to the chassis while a second end of each arm is fastened to the outer door.

4. A device according to claim 1, wherein the covering means (35) is shaped as a flap which is pivotally supported at a lower, inner edge of the inner door when the door is in the closed position, a portion of the flap abutting the bottom (32) of the treatment chamber being shaped as a scraping edge (37).

* * * * *